US005978636A

United States Patent [19]

Yamamoto et al.

[11] Patent Number: 5,978,636

[45] Date of Patent: Nov. 2, 1999

[54] DEVELOPER AMOUNT RESTRICTING MEMBER AND DEVELOPING DEVICE

[75] Inventors: Arihiro Yamamoto, Kawasaki; Masahiro Watabe, Yokohama; Hisao Kato, Ooi-machi, all of Japan

[73] Assignee: Canon Kabushiki Kaisha, Tokyo, Japan

[21] Appl. No.: 09/252,825

[22] Filed: Feb. 19, 1999

[30] Foreign Application Priority Data

Feb. 26, 1998 [JP] Japan ..... 10-062197

[51] Int. Cl.[6] ..... G03G 15/08

[52] U.S. Cl. ..... 399/284; 399/274

[58] Field of Search ..... 399/257, 264, 399/272, 273, 283, 284

[56] References Cited

U.S. PATENT DOCUMENTS 4,666,815 5/1987 Imai et al. ..... 430/126
5,353,104 10/1994 Kato et al. ..... 355/259
5,485,254 1/1996 Bogoshian et al. ..... 399/284
5,689,783 11/1997 Sasame et al. ..... 399/284
5,713,120 2/1998 Watabe et al. ..... 29/527.4
5,729,806 3/1998 Niwano et al. ..... 399/284
5,893,013 4/1999 Kinoshita et la. ..... 399/284
5,895,150 4/1999 Watabe ..... 399/284

*Primary Examiner*—Arthur T. Grimley
*Assistant Examiner*—Hoang Ngo
*Attorney, Agent, or Firm*—Fitzpatrick, Cella, Harper & Scinto

[57] ABSTRACT

A developer amount restricting member for restricting the amount of developer on a developer bearing member has: (a) an elastic member urged toward the developer bearing member; and (b) a supporting member supporting the elastic member, wherein, when the transverse end portion of the supporting member is supported, the longitudinal end portions of the elastic member warp toward the supporting member.

18 Claims, 2 Drawing Sheets

DEVELOPER AMOUNT RESTRICTING MEMBER AND DEVELOPING DEVICE

BACKGROUND OF THE INVENTION

1. Field of the Invention

The present invention relates to a developing device used for visualizing an electrostatic latent image formed on an image bearing member of an image forming apparatus, and to a developer amount restricting member for restricting an amount of developer on a developer bearing member.

2. Related Background Art

In an electrophotographic image forming apparatus, an electrostatic latent image formed on an image bearing member is visualized by developing the latent image with using developer in a developing device.

As shown in FIG. 4, in this developing device, a developing sleeve 103, as a developer bearing member, rotating in the direction shown by the arrow bears on its surface toner (developer), not shown in the figure, and conveys the toner to a developing portion opposite to an image bearing member, and on the way to the developing portion the toner is made to pass between the developing sleeve 103 and a rubber or metallic blade for restricting the amount of developer (a developing blade) 104 which is in contact with the surface of the developing sleeve 103 so that the amount of the toner to be conveyed will be restricted, thus a thin layer of the toner is formed on the developing sleeve 103 and the toner is imparted with a triboelectric charge (triboelectricity) suitable for developing a latent image.

For a rubber developing blade 104, a simple rubber sheet of, for example, polyurethane rubber is sometimes used, but often used is the type in which a rubber sheet 104*b* as a triboelectricity charging member is supported by a metalic supporting member 104*a*.

In recent years it has been an important problem to improve the performance of a developing blade, such as triboelectrifying property and toner fusing preventive property, so as to deal with various types of toner including the latest one.

Recently there appear various types of toner, such as a low meltpoint toner (a sharp melt toner) which is provided with a property to fix at a lower temperature than a conventional one in terms of saving energy, toner (non-magnetic toner) which is provided with no magnetism to keep up with coloration of printing, or polymer toner.

These types of toner are required to exhibit an especially high triboelectrifying property. For example, increasing the contact pressure of the developing blade 104 against the developing sleeve 103 ensures a requisite triboelectrifying property.

An increased contact pressure, however, makes it easier for toner to adhere to the surface of the developing blade 104, which leads to formation of deposit of toner especially at the end portions of the developing blade, and hence a remarkable occurrence of toner fusing. Occurrence of toner fusing on the surface of the developing blade leads to a reduction in triboelectrifying property of the developing blade, and hence an insufficiently charged toner, which may present a threat of leakage of toner from the developing device, resulting in contamination of not only the inside of the developing device but the whole inside of the image forming apparatus.

One possible way to solve this problem might be to use a surface material which exhibits sufficient triboelectrifying property even under a light contact pressure; for example, for negative toner, it would be better to use nylon-based resins, which tends to be charged positively in itself, for a triboelectrifying member 104*b*. However, use of a developing blade whose surface material is high in flatness creates a difference in contact pressure between its longitudinal central portions and end portions. This limits the selection of a developing blade which can realize the contact pressure under which a good triboelectrifying property is obtained. Thus great accuracy is required in setting up a developing blade etc., which may cause an increase in manufacturing cost of not only a developing device but of an image forming apparatus.

SUMMARY OF THE INVENTION

Thus it is an object of the present invention to provide a developer amount restricting member for restricting the amount of developer which enables to prevent toner from fusing at its end portions, and to provide a developing device provided with the same.

Further it is another object of the present invention to provide a developer amount restricting member for restricting the amount of developer on an image bearing member which has:

(a) an elastic member urged toward a developer bearing member, (b) a supporting member for supporting the elastic member, wherein, when the elastic member is supported at its transverse end portion, the longitudinal end portions of the elastic member warp toward the supporting member.

The foregoing and other objects and features of the invention will become more apparent from the following detailed description with reference to the accompanied drawings.

DESCRIPTION OF THE PREFERRED EMBODIMENTS

Figure 1:
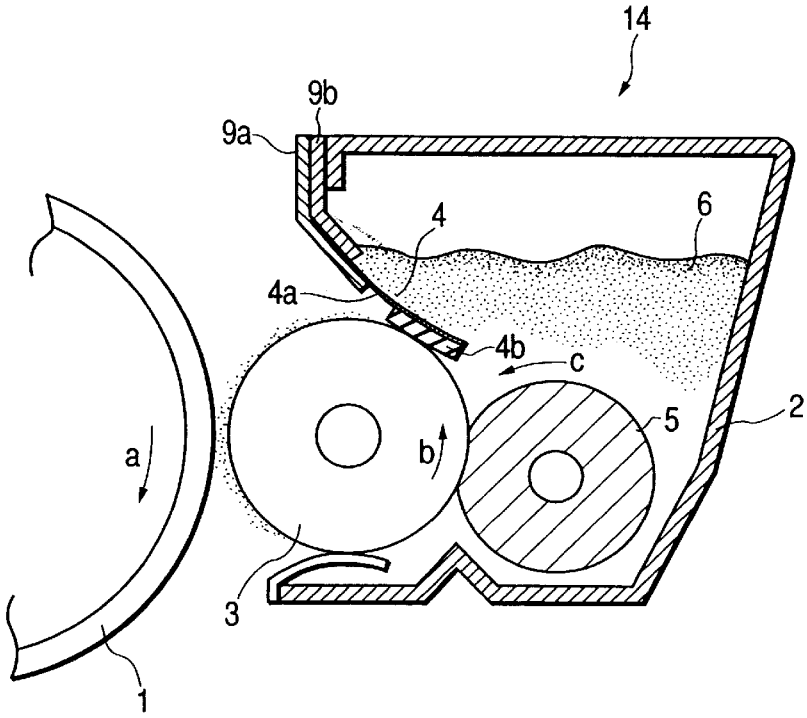
FIG. 1 is a sectional view of an embodiment of a developing device of the invention.

FIG. 1 is a schematic view of an embodiment of a developing device of the invention.

The developing device 14 is provided with a developing sleeve 3, as a toner bearing member, at the opening of a developing container 2 containing toner 6 which faces a photosensitive drum 1, as an image bearing member. The developing sleeve 3 is installed sideways rotatably at the above opening in such a manner that the right almost half circumference of the developing sleeve 3 is plunged into the developing container 2, the left almost half circumference of the developing sleeve 3 is exposed to the outside of the developing container 2 to face the photosensitive drum 1. There provided a very slight clearance between the developing sleeve 3 and the photosensitive drum 1. The developing sleeve 3 is driven to rotate in the direction shown by the arrow b, while the photosensitive drum 1 rotates in the direction shown by the arrow a.

In the developing container 2, a developing blade 4 is installed above the developing sleeve 3 and an elastic roller 5 is installed at the upstream side of the developing blade 4 in the rotational direction of the developing sleeve 3.

The developing blade 4 consists of a supporting member 4*a* and a triboelectrifying member (an elastic member) 4*b* placed to the end portion in a direction perpendicular (transverse) to the longitudinal axis (the same direction as the longitudinal axis of the developing sleeve 3) of the supporting member 4*a*. Preferably the thickness of the supporting member 4*a* is in the 0.05 to 0.5 mm range. And preferably the thickness of the triboelectrifying member 4*b* is in the 0.5 to 3 mm range. Since the developing blade 4 is installed on the developing container 2 via the supporting member 4*a,* it is placed in such a manner that it is tilted down in the upstream direction of rotation of the developing sleeve 3, and the triboelectrifying member 4*b* is elastically urged in the direction opposite to rotation of the developing sleeve 3 to come into contact with the upper circumference surface of the developing sleeve 3.

According to the present embodiment, the developing blade 4 is formed in such a manner that its surface in contact with the developing sleeve 3 has an uneven flatness at both of its longitudinal end portions within 30 mm from each very end. This will be discussed later.

The elastic roller 5 is a member for stripping/feeding toner off/to the developing sleeve 3, and it is in contact with the developing sleeve 3 on its side opposite to the photosensitive drum 1 and is supported rotatably.

The developing device has the constitution described above, wherein the elastic roller 5 rotates in the direction shown by the arrow c; with the rotation of the elastic roller 5, toner 6 borne on the elastic roller 5 is fed in the vicinity of the developing sleeve 3; the toner 6 on the elastic roller 5 is rubbed with the developing sleeve 3 at the portion where the developing sleeve 3 and the elastic roller 5 come into contact with each other (nipping portion); thus the toner 6 adheres to the developing sleeve 3 and is borne on it.

With the rotation of the developing sleeve 3, the toner 6 borne on the developing sleeve 3 is conveyed to the portion where the developing sleeve 3 and the developing blade 4 come into contact with each other, enters between the developing blade 4 and the developing sleeve 3, and is rubbed with the surfaces of both developing sleeve 3 and the developing blade 4, when passing between them, to be sufficiently imparted with triboelectricity. Then when the toner 6 slips out of between the developing blade 4 and the developing sleeve 3, the toner 6 is in the form of a thin layer formed on the developing sleeve 3.

The toner 6 in the form of a thin layer formed on the developing sleeve 3 is then conveyed to the developing portion where the developing sleeve 3 and the photosensitive drum 1 face each other with a very slight clearance between them. At the developing portion, by applying an alternating voltage as a developing bias between the developing sleeve 3 and the photosensitive drum 1 in such a manner that direct and alternating currents are superposed, the toner 6 on the developing sleeve 3 is transferred and adheres to the photosensitive drum 1 in correspondence to the electrostatic latent image of the photosensitive drum 1 to develop the latent image; thus the latent image is visualized as a toner image.

The toner 6 which has not been consumed at the developing portion and remained on the developing sleeve 3 is recovered in the developing container 2 through the lower part of the developing sleeve 3 while the developing sleeve 3 is rotating. The recovered toner 6 is stripped off the developing sleeve 3 by the elastic roller 5 at the portion where the developing sleeve 3 and the elastic roller 5 come into contact with each other. At the same time, due to the rotation of the elastic roller 5, fresh toner 6 is fed to the surface of the developing sleeve 3, and again the fresh toner 6 is conveyed to the portion where the developing sleeve 3 and the elastic blade 4 come into contact with each other.

Most of the toner 6 stripped off, as described above, is conveyed to the toner 6 contained in the developing container 2 as the developing sleeve 3 rotates and mixed in the toner 6 contained therein, thus the electrical charge of the toner stripped off is dispersed.

For toner 6 magnetic toner, non-magnetic color toner or the like is used, and the average particle diameter is preferably about 3 $\mu$m to 15 $\mu$m.

In the present embodiment, when the transverse end portion of the supporting member 4*a* is supported, the longitudinal end portions of the triboelectrifying member 4*b* warp toward the supporting member 4*a*. The developing blade 4 having such a shape can be obtained by forming the triboelectrifying member 4*b* using a certain material and molding process.

According to the present embodiment, in the developing blade 4 having an uneven flatness at both its end portions, warping degree has a certain value described below.

Figure 2:
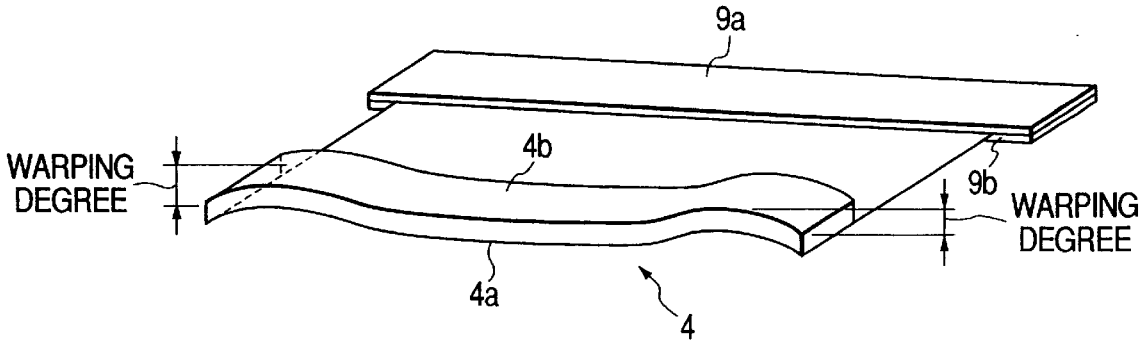
FIG. 2 is a view illustrating the method of measuring the warping degree of the developing blade of the invention.

As shown in FIG. 2, when the supporting member 4*a* of the developing blade 4 is mounted in the developing container 2 of the developing device of FIG. 1 in such a manner that the supporting member 4*a* is sandwiched between a pair of fixing sheet metals 9*a* and 9*b,* there arises an uneven flatness on the surface of the developing blade 4 where it comes into contact with the developing sleeve 3. Warping degree is defined as the difference between the maximum and minimum values of the contact surface within 30 mm from each end surface of both end portions of the developing blade 4 mounted in the developing container 2. In the present embodiment, the developing blade 4 should have the minimum values of the contact surface at each end surface of both end portions, and the warping degree ranges from 10 $\mu$m to 450 $\mu$m. FIG. 2 shows the state in which the developing sleeve 3 has not been placed in the developing device yet, and this state is the same as that in which the transverse end portion of the supporting member 4*a* is supported.

Providing that the developing blade 4 has a warping degree within the range of 10 $\mu$m to 450 $\mu$m, a preferred contact with the developing sleeve 3 can be achieved at both its end portions under a light pressure. If the above warping degree is less than 10 $\mu$m, reducing the contact pressure may not be effective. And if the above warping degree is more than 450 $\mu$m, a gap is produced at the portion where the developing blade 4 comes into contact with the developing sleeve 3, which may lead to an unsufficient triboelectric charge of toner, and hence toner leakage.

The developing blade 4 having the above constitution is obtained by forming an elastic triboelectrifying member 4*b* in such a manner that a thermoplastic resin elastomer (rubber) is subjected to injection- and compression-molding in the die into which a supporting member 4*a* consisting of spring sheet metal has been inserted, thus the developing blade 4 is formed to have a shape such that it warps toward the supporting member 4*a,* in other words, to have a convex shape where the surface of the rubber side has a curvature. When mounted in a developing device, the developing blade 4 thus formed has an uneven flatness on the surface where the developing blade 4 comes into contact with a developer bearing member 3 and a minimum flatness value at each end surface of both end portions of the developing blade 4.

For example, elastomer is filled into a die by injection whose cavity is about 1.5 times as deep as the desired thickness of the rubber, then the elastomer is mechanically compressed to the desired thickness before it becomes solidified by cooling, which causes the elastomer to be in the over filled state. The elastomer in the over filled state has stress remaining in it, and due to the stress, the elastomer warps toward the supporting member. In other words, the molded product of the developing blade 4 having any desired warping degree can be obtained by varying the filling amount of and the compressive force to the elastomer.

The molded product obtained tends to return to the planar state, if it is annealed at an appropriate temperature, due to the relaxation of the residual stress. Accordingly, use of a crystalline thermoplastic resin elastomer particularly makes it possible to form a developing blades 4 having any desired curvature, because its crystallization induces shrinkage.

Here as a thermoplastic resin elastomer, applicable are, for example, polyether block amides which are block copolymers of polyamide and polyether. As a polyamide component, used are polyamide 6, 6·6, 6·10, 6·12, 11, 12, 12·12 and polyamides obtained by polycondensation between different types monomers thereof, preferably polyamides whose polyamide terminal amino group is carboxylated with dibasic acid.

Examples of dibasic acids used are saturated aliphatic dicarboxylic acids such as nitric acid, succinic acid, adipic acid, suberic acid, sebacic acid and dodecanoic diacid; unsaturated aliphatic dicarboxylic acids such as maleic acid; aromatic dicarboxylic acids such as phthalic acid and terephthalic acid; and polydicarboxylic acids synthesized with these dibasic acids and diols such as ethylene glycol, butanediol, hexanediol, octanediol and decanediol.

As a polyether component, used are polyether diols such as homopolymerized or copolymerized polyethylene glycol, polypropylene glycol and polytetramethylene glycol, and polyether diamine whose end groups are aminated. From these polyethers and carboxylated polyamides, block copolymers of polyether and polyamide having an ester bonding (polyether polyester amide) or amide bording (polyether polyamide) are formed.

Since the developing device of the present embodiment uses the developing blade 4 having the constitution described above, contact under a light pressure can be realized at both end portions of the developing sleeve 3, which leads to the prevention of toner fusing at the end portions of the developing blade 4, and hence the prevention of toner leakage due to its fusing.

Figure 3:
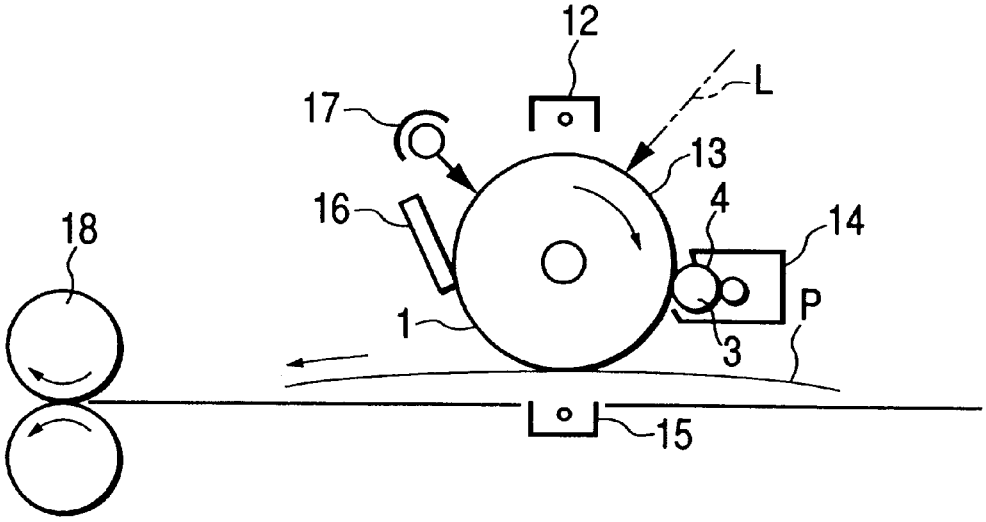
FIG. 3 is a sectional view of one example of electrophotographic device suitable for employing the developing device of the invention.
Figure 4:
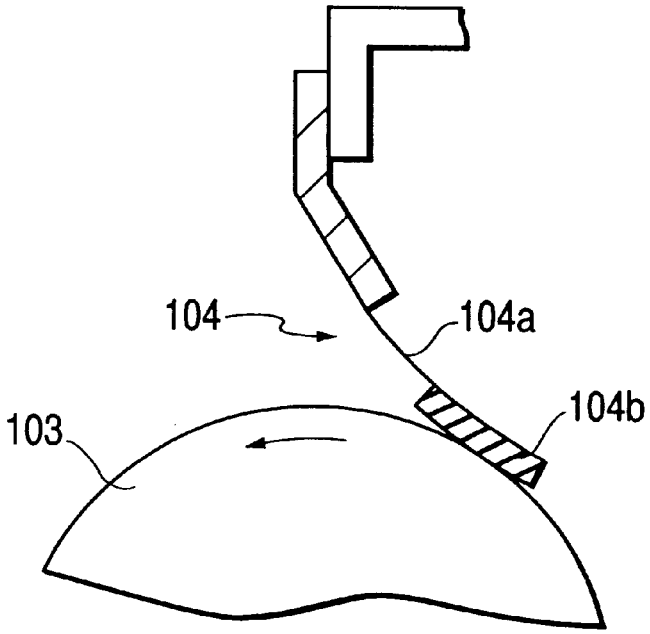
FIG. 4 is a view illustrating the restriction of the toner on the developing sleeve by the developing blade in the developing device of the invention.

FIG. 3 shows one example of electrophotographic device suitable for employing the developing device of the present embodiment.

In FIG. 3, photosensitive drum 1 is a drum type electrophotographic photosensitive member having an electrically conductive supporting material such as aluminum and a photosensitive layer formed on the peripherical surface thereof as basic constitutive layers. Photosensitive drum 1 is driven to rotate around its supporting axis at a certain peripheral velocity clockwise in the drawing.

The surface of the photosensitive drum 1 is uniformly charged with electricity by corona discharge tube 12 to have a certain polarity and electric potential, the charged photosensitive drum 1 is then subjected to exposure light L, which is the subject image information, from exposing means (laser beam scanning exposure, slit exposure of original image, etc.); thus electrostatic latent image 13 corresponding to the image information is formed on the surface of the photosensitive drum 1. The electrostatic latent image 13 is developed by developing device 14 to give a toner image.

Transfer medium P is conveyed from a feeding means, which does not appear in the drawing, to the photosensitive drum 1, and then to a transfer portion between the photosensitive drum 1 and the transfer means 15 with a proper timing synchronized with the rotation of the photosensitive drum 1. Toner image formed on the photosensitive drum 1 is transfered to the surface of the transfer medium P by the action of the transfer means 15.

The transfer medium P having received toner image is separated from the photosensitive drum 1, sent to a hot fixing roller 18 where the toner image is fixed on the transfer medium P, and output as a printed image. After transferring toner image, the photosensitive drum 1 is cleaned using a cleaning means 16 by removing contaminants adhereing to it such as toner left after transferring from its surface, and again used for image formation.

A plurality of process elements of the electrophotographic device, such as the photosensitive drum 1, the charging device 12, the developing device 14 and the cleaning means 16, can be integrally incorporated in a process cartridge. This process cartridge is removably installed on the body of an image forming apparatus by using guiding means such as a rail provided in the body.

Examples of the electrophotographic apparatus to which the developing device of the present embodiment is applicable are a copying machine, a laser beam printer, an LED printer, or an apparatus to which electrophotography is applied, such as a photoengraving system for electrophotography.

While the invention has been described in terms of electrophotographic apparatuses which form monochromatic images, in color LBPs which form color images with using four colors of toner, the color images can be obtained in such a manner that four developing devices identical to the developing device 14 are installed for four colors; latent images of respective colors are developed on the photosensitive drum 1; and each time when a toner image of each color is obtained, the image is transferred to an intermediate transfer medium such as roller and belt; then four colors of toner images transferred to the intermediate transfer medium are transferred and fixed to a transfer medium collectively.

Now the present embodiment will be described in detail with reference to the following examples.

EXAMPLE 1

A phosphor bronze plate of about 0.1 mm thickness was provided in a die as a supporting member 4*a*, and a polyamide elastomer (Diamid PAE E40-S3, manufactured by Daicel Huels K. K.) which is a thermoplastic elastomer was injected into the die after being dried at 70° C. for 6 hours, and subjected to injection compression molding at a melt temperature of 250° C. and mold temperature of 40° C. to give a molded product consisting of a supporting member 4*a* and a polyamide elastomer triboelectrifying member 4*b* of about 1 mm thickness formed thereon. The molded product was then annealed in an electric furnace at 70° C. for 60 minutes, and cut in a predetermined size to provide a developing blade 4.

EXAMPLE 2

A developing blade 4 was obtained in the same manner as in Example 1, except that the annealing temperature was 60° C.

EXAMPLE 3

A developing blade 4 was obtained in the same manner as in Example 1, except that the annealing temperature was 50° C.

EXAMPLE 4

A developing blade 4 was obtained in the same manner as in Example 1, except that the annealing temperature was 40° C.

COMPARATIVE EXAMPLE 1

A developing blade 4 was obtained in the same manner as in Example 1, except that the annealing temperature was 80° C.

COMPARATIVE EXAMPLE 2

A developing blade 4 was obtained in the same manner as in Example 1, except that the annealing temperature and time were 40° C. and 30 minutes, respectively.

COMPARATIVE EXAMPLE 3

The molded product obtained in Example 1 was not annealed and cut in a predetermined size to provide a developing blade 4.

Each developing blade 4 obtained in the above examples 1 to 4 as well as comparative examples 1 to 3 and a developing sleeve 3 were installed on a developing device 14 shown in FIG. 1 in such a manner that the contact pressure between the developing blade and the developing sleeve becomes 18 gf/cm. For the developing sleeve 3, used were aluminium tubes which were subjected to blast treatment to have ten-point-average roughness, Rz=2.5 μm. On a developing container 2, a sponge roller of urethane foam was installed as an elastic roller 5. This sponge roller is suitable for applying toner fully to the developing sleeve as well as stripping off the toner left undeveloped on the developing sleeve to return it to the developing container 2 again.

This developing device was installed on a no-load rotating machine of a laser beam printer (Lasershot manufactured by Canon), and no-load rotation endurance tests were conducted under the environmental condition of room temperature for 8 hours, using non-magnetic black toner. Toner leakage due to its fusing in the developing blade 4 was observed visually. Table 1 shows the results. In Table 1, the mark ○ indicates that the phenomenon of each item was not observed, while mark x indicates that the phenomenon of each item was observed.

As shown in Table 1, in Example 1 to 4 toner leakage did not occur during the eight hours no-load rotation, while in Comparative Example 2 and 3 toner leakage, which seems to be due to the gap made between the developing blade and the developing sleeve at their end portions, occurred at the beginning of the tests. And in Comparative Example 1, toner leakage, which seems to be due to the fusing of toner into the end portion of the developing blade, occurred one hour after the beginning of no-load rotation.

Although a developing blade 300 mm in length was used in the present embodiment, the above warping degrees are also applicable to those 200 to 350 mm in length.

As described above, a developer amount restricting member for restricting the amount of developer on a developer bearing member has:

(a) an elastic member urged toward the developer bearing member and (b) a supporting member supporting the elastic member, wherein, when the transverse end portion of the supporting member is supported, the longitudinal end portions of the elastic member warp toward the supporting member.

And a developing device has:

(a) a developer bearing member for bearing and conveying a developer and (b) a developer amount restricting member for restricting the amount of developer on a developer bearing member, wherein the developer amount restricting member has:

an elastic member urged toward the developer bearing member; and a supporting member supporting the elastic member, wherein, before the developer bearing member is provided, when the transverse end portion of the supporting member is supported, the longitudinal end portions of the elastic member warp toward the supporting member.

As described above, according to the present embodiment, it is possible to realize the contact between the developer amount restricting member and the developer bearing member at both end portions of the developer amount restricting member under a light pressure, which enables the prevention of toner fusing, and hence the prevention of toner leakage due to the fusing of toner.

What is claimed is:

1. A developer amount restricting member for restricting the amount of developer on a developer bearing member comprising:

TABLE 1

| | Example 1 | Example 2 | Example 3 | Example 4 | Comparative Example 1 | Comparative Example 2 | Comparative Example 3 |
|---|---|---|---|---|---|---|---|
| Annealing Temperature | 70° C. | 60° C. | 50° C. | 40° C. | 80° C. | 40° C. | none |
| Annealing Time | 60 min | 60 min | 60 min | 60 min | 60 min | 30 min | none |
| Warping Degree | 10 μm | 50 μm | 100 μm | 450 μm | 0 μm | 470 μm | 500 μm |
| Contact Gap at End Portion | ○ | ○ | ○ | ○ | ○ | x | x |
| Toner Fusing at End Portion | ○ | ○ | ○ | ○ | x | ○ | ○ |
| Toner Leakage at End Portion | ○ | ○ | ○ | ○ | x (1 hour) | x (at the beginning) | x (at the beginning) |

○ . . . None, x . . . Present an elastic member for being urged toward the developer bearing member; and a supporting member supporting said elastic member, wherein, when an end portion in a direction crossing a longitudinal direction of said supporting member is supported, longitudinal end portions of said elastic member warp toward said supporting member.

2. The developer amount restricting member according to claim 1, wherein a warping degree is within a range of 10 μm to 450 μm.

3. The developer amount restricting member according to claim 1, wherein said supporting member has a thickness within a range of 0.05 mm to 0.5 mm.

4. The developer amount restricting member according to claim 1, wherein said elastic member has a thickness within a range of 0.5 mm to 3 mm.

5. A developing device comprising:

a developer bearing member for bearing and conveying a developer; and a developer amount restricting member for restricting an amount of developer on said developer bearing member, said developer amount restricting member including:

an elastic member for being urged toward said developer bearing member; and a supporting member supporting said elastic member, wherein, before said developer bearing member is provided and in a state in which an end portion in a direction crossing a longitudinal direction of said supporting member is supported, longitudinal end portions of said elastic member warp toward the supporting member.

6. The device according to claim 5, wherein a warp degree is within the range of 10 μm to 450 μm.

7. The device according to claim 5, wherein the supporting member has a thickness within the range of 0.05 mm to 0.5 mm.

8. The device according to claim 5, wherein the elastic member has a thickness within the range of 0.5 mm to 3 mm.

9. A developing device comprising:

a developer bearing member for bearing and conveying a developer; and a developer amount restricting member for restricting an amount of developer on said developer bearing member, wherein said developer amount restricting member abuts against said developer bearing member, wherein an abutting pressure of said developer amount restricting member against said developer bearing member is smaller at longitudinal end portions of said developer bearing member than at a center portion thereof.

10. A developing device according to claim 9, wherein said developer amount restricting member comprises an elastic member for being urged toward the developer bearing member and supporting member supporting said elastic member.

11. A developing device according to claim 10, wherein, in a condition where said developer bearing member is not attached, the longitudinal end portions of said elastic member warp toward the supporting member.

12. A developing device according to claim 11, wherein a warping degree of said elastic member is within a range of 10 μm to 450 μm.

13. A developing device according to claim 11, wherein said supporting member has a thickness within a range of 0.5 mm to 3 mm.

14. A developing device according to claim 11, wherein said elastic member has a thickness within a range of 0.5 mm to 3 mm.

15. A developer amount restricting member for restricting an amount of developer on a developer bearing member, wherein said developer amount restricting member is manufactured comprising the following steps:

inserting a supporting member into a mold;

injecting a resin into said mold; and pressing said resin to a predetermined thickness before said resin is hardened, wherein, when an end portion in a direction crossing a longitudinal direction of said supporting member is supported, longitudinal end portions of said resin warp toward said supporting member.

16. A developer amount restricting member according to claim 15, wherein said supporting member has a thickness within a range of 0.05 mm to 0.5 mm.

17. A developer amount restricting member according to claim 15, wherein said elastic member has a thickness within a range of 0.5 mm to 3 mm.

18. A developer amount restricting member according to claim 15, wherein said resin has a thickness within a range of 0.5 mm to 3 mm.

* * * * *

UNITED STATES PATENT AND TRADEMARK OFFICE

CERTIFICATE OF CORRECTION

PATENT NO. : 5,978,636

DATED : November 2, 1999

INVENTOR(S) : Arihiro YAMAMOTO, et al.

It is certified that error appears in the above-identified patent and that said Letters Patent is hereby corrected as shown below:

COLUMN 1:

Line 34, "metalic" should read --metallic--.
Line 54, "toner" should read --the toner--.

COLUMN 2:

Line 66, "b," should read --"b",--.
Line 67, "a." should read --"a".--.

COLUMN 3:

Line 32, "c;" should read --"c";--.

COLUMN 5:

Line 19, "blades" should read --blade--.

UNITED STATES PATENT AND TRADEMARK OFFICE

CERTIFICATE OF CORRECTION

PATENT NO. : 5,978,636

DATED : November 2, 1999

INVENTOR(S) : Arihiro YAMAMOTO, et al.

It is certified that error appears in the above-identified patent and that said Letters Patent is hereby corrected as shown below:

COLUMN 7:

Line 43, "o" should read --"o"--.
Line 44, "x" should read --"x"--.

Signed and Sealed this

Second Day of January, 2001

*Attest:*

*Attesting Officer*

Q. TODD DICKINSON

*Commissioner of Patents and Trademarks*